US005086522A

United States Patent [19]

Stofko, Sr.

[11] Patent Number: 5,086,522

[45] Date of Patent: Feb. 11, 1992

[54] DRAIN PLUG APPARATUS

[76] Inventor: George D. Stofko, Sr., Box 186, R.D. #1, Pittston, Pa. 18640

[21] Appl. No.: 541,325

[22] Filed: Jun. 21, 1990

[51] Int. Cl.[5] ..... A47K 1/14; F16K 31/44

[52] U.S. Cl. ..... 4/295; 251/264; 182/1.5; 222/519

[58] Field of Search ..... 4/295, 287; 251/215, 251/351, 264; 184/1.5; 222/519; 220/254; 215/356; 138/89

[56] References Cited

U.S. PATENT DOCUMENTS

| | | | |
|---|---|---|---|
| 982,009 | 1/1911 | Morgan | 251/351 X |
| 1,652,929 | 12/1927 | Cawood | 251/264 X |
| 3,719,345 | 3/1973 | Bridegum | 251/351 |
| 3,776,433 | 12/1973 | De Treites | 222/519 |
| 3,948,481 | 4/1976 | Pollock | 184/1.5 X |
| 4,025,048 | 5/1977 | Tibbitts | 184/1.5 X |
| 4,470,577 | 9/1984 | Warwick | 251/351 X |
| 4,748,998 | 6/1988 | Farber et al. | 251/351 X |
| 4,807,847 | 2/1989 | Martz | 251/351 X |

FOREIGN PATENT DOCUMENTS

| | | | |
|---|---|---|---|
| 2160983 | 6/1973 | Fed. Rep. of Germany | 251/215 |

*Primary Examiner*—Henry J. Recla
*Assistant Examiner*—Glenn T. Barrett
*Attorney, Agent, or Firm*—Leon Gilden

[57] ABSTRACT

A drain plug apparatus includes securement to an associated fluid reservoir, wherein the apparatus further includes a pressure nut mounted to the reservoir, with a discharge screw directed through the pressure nut, wherein the discharge screw includes a central conduit cooperative with and in fluid communication with a through-extending head conduit arranged orthogonally relative to the through-extending conduit to direct fluid from the reservoir exteriorly thereof. The discharge screw includes a conical head to be received within a conical seat formed within the pressure nut. The pressure nut may include a boss directed exteriorly of the pressure nut and integral therewith to receive a tube thereabout to permit directing of discharge fluid through an associated flexible tube to be received within an associated container.

3 Claims, 5 Drawing Sheets

PRIOR ART

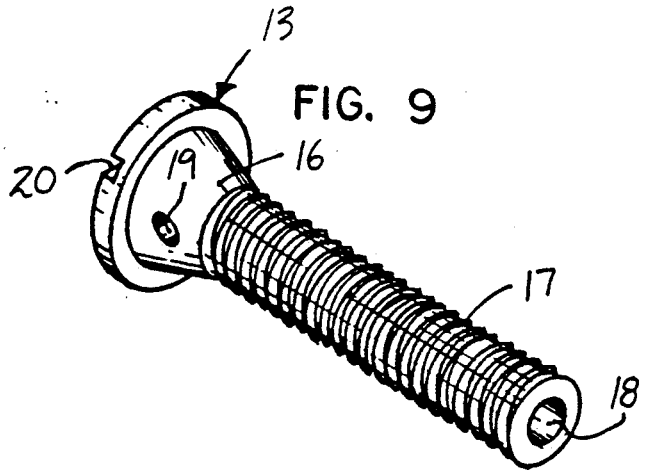
FIG. 9
FIG. 10
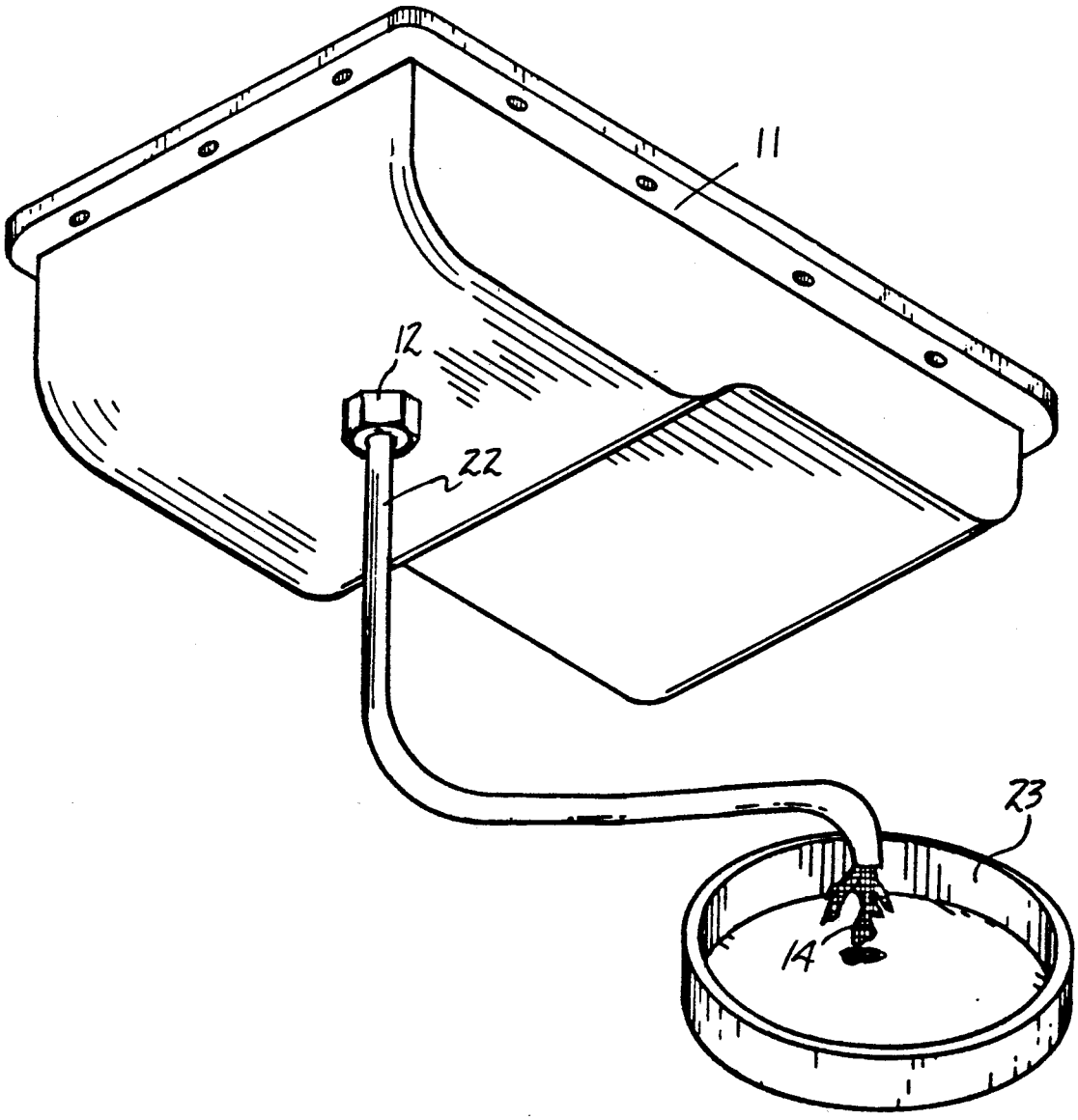

DRAIN PLUG APPARATUS

BACKGROUND OF THE INVENTION

1. Field of the Invention

The field of invention relates to drain plug apparatus, and more particularly pertains to a new and improved drain plug apparatus wherein the same permits a conical seat of an associated drain plug screw to be displaced relative to an associated seat to effect discharge of a fluid from an associated reservoir.

2. Description of the Prior Art

Maintenance and drainage of various reservoirs is a time consuming and labor intensive procedure. Frequently, various reservoir valves and openings are rendered inoperative due to over-torquing and the like. The instant invention attempts to overcome deficiencies of the prior art by providing a reservoir valve wherein a screw slotted member accommodates a minimal application of torque to effect a sealing and releasing of the valve relative to an associated seat. Prior art organizations may be found in U.S. Pat. No. 4,381,569 to Ingram wherein an adjustable drain plug utilizes an adjustable shank to accommodate various lengths in positioning of the drain plug within a plumbing environment.

U.S. Pat. No. 4,683,597 to Taylor, Jr., et al. sets forth a drain plug wherein a central resilient plug is sandwiched between plates secured together by a central fastener member.

U.S. Pat. No. 1,630,351 to Mortimer sets forth a valve arrangement for plumbing fixtures wherein the same utilizes a removable central plug member positioned within a conduit to effect selective drainage through the conduit.

U.S. Pat. No. 4,143,432 to Deken sets forth an adjustable drain plug utilizing a base and relatively rotatable central portion to effect selective opening of the drain plug relative to the central portion.

U.S. Pat. No. 3,468,512 to Politz sets forth a drain plug with a reciprocatably positionable central plug member relative to a surrounding conduit to effect drainage to the central conduit.

As such, it may be appreciated that there continues to be a need for a new and improved drain plug apparatus wherein the same addresses both the problems of ease of use, as well as effectiveness in construction and in this respect, the present invention substantially fulfills this need.

SUMMARY OF THE INVENTION

In view of the foregoing disadvantages inherent in the known types of drain plug apparatus now present in the prior art, the present invention provides a drain plug apparatus wherein the same utilizes a central hollow stem member displaceable from an associated seat to effect drainage of the stem and an associated conduit that is sealed when the stem is seated within a compression member. As such, the general purpose of the present invention, which will be described subsequently in greater detail, is to provide a new and improved drain plug apparatus which has all the advantages of the prior art drain plug apparatus and none of the disadvantages.

To attain this, the present invention provides a drain plug apparatus including securement to an associated fluid reservoir, wherein the apparatus further includes a pressure nut mount to the reservoir, with a discharge screw directed through the pressure nut, wherein the discharge screw includes a central conduit cooperative with and in fluid communication with a through-extending conduit to direct fluid from the reservoir exteriorly thereof. The discharge screw includes a conical head to be received with a conical seat formed within the pressure nut. The pressure nut may include a boss directed exteriorly of the pressure nut and integral therewith to receive a tube thereabout to permit directing of discharge fluid through an associated flexible tube to be received within an associated container.

My invention resides not in any one of these features per se. but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved drain plug apparatus which has all the advantages of the prior art drain plug apparatus and none of the disadvantages.

It is another object of the present invention to provide a new and improved drain plug apparatus which may be easily and efficiently manufactured and marketed.

It is a further object of the present invention to provide a new and improved drain plug apparatus which is of a durable and reliable construction.

An even further object of the present invention is to provide a new and improved drain plug apparatus which is susceptible of a low cost of manufacture with regard to both materials and labor, and which accordingly is then susceptible of prices of sale to the consuming public, thereby making such drain plug apparatus economically available to the buying public.

Still yet another object of the present invention is to provide a new and improved drain plug apparatus which provides in the apparatuses and methods of the prior art some of the advantages thereof, while simultaneously overcoming some of the disadvantages normally associated therewith.

Still another object of the present invention is to provide a new and improved drain plug apparatus wherein the same permits selective drainage of an associated reservoir through a central hollow stem secured within a compression seat during periods of non use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is an isometric illustration of the discharge screw set forth by the instant invention.

FIG. 10 is an isometric illustration of the instant invention in use with a directional flexible tube.

DESCRIPTION OF THE PREFERRED EMBODIMENT

Figure 1:
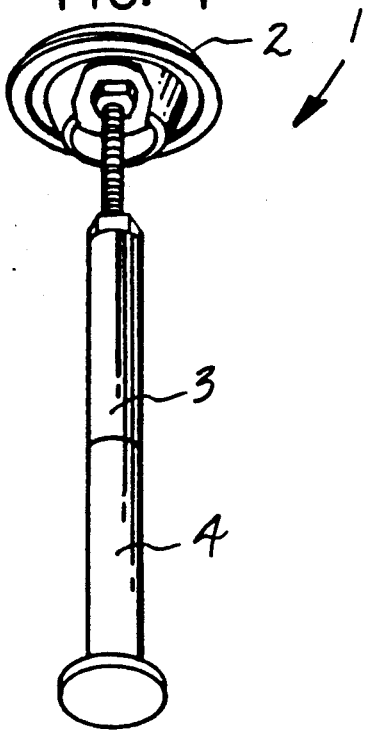
FIG. 1 is an isometric illustration of a prior art drain plug apparatus.

With reference now to the drawings, and in particular to FIGS. 1 to 10 thereof, a new and improved drain plug apparatus embodying the principles and concepts of the present invention and generally designated by the reference numeral 10 will be described.

Figure 2:
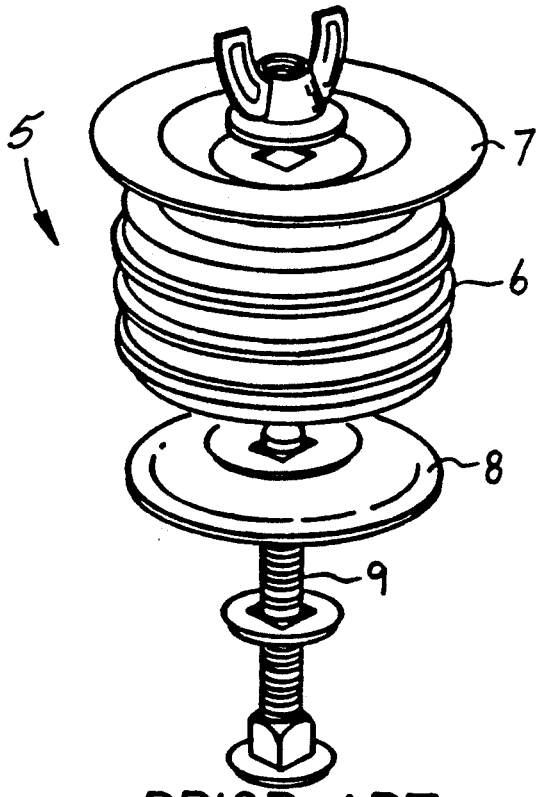
PRIOR ART FIG. 2
FIG. 2 is an isometric illustration of a further prior art drain plug apparatus.
Figure 3:
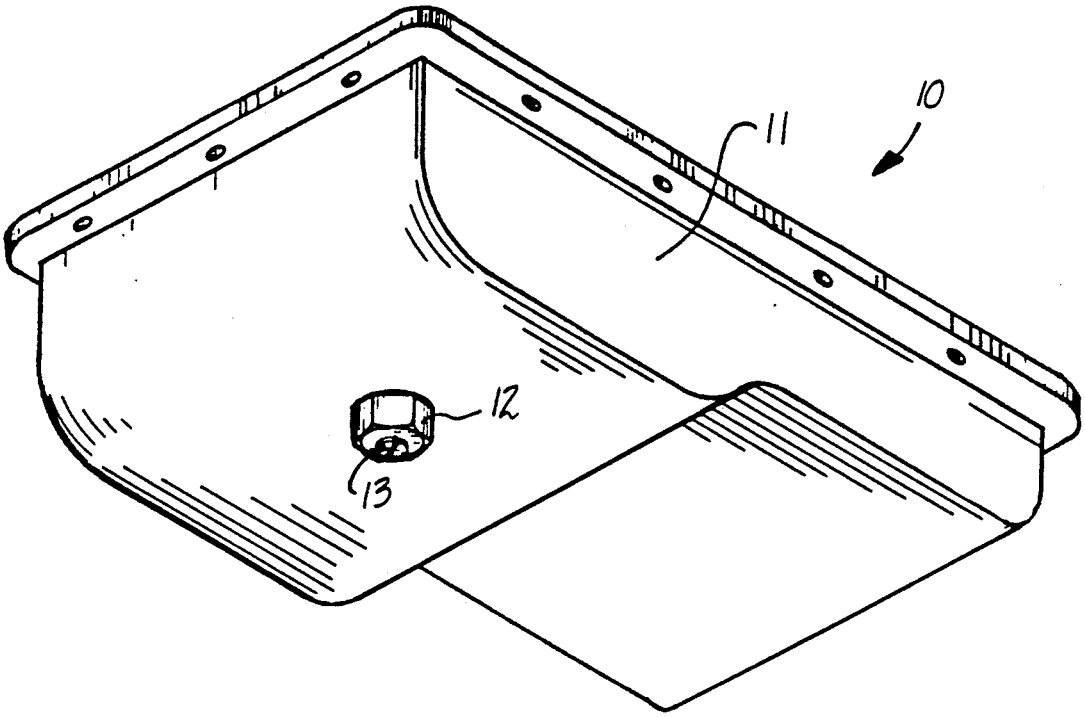
FIG. 3 is an isometric illustration of the instant invention.

FIG. 1 illustrates a prior art drain plug apparatus 1, wherein a cap 2 includes a first and second stem member 3 relatively adjustable to provide adjustment of an effective length defined by the members 3 and 4 to accommodate a lift plate utilized in a plumbing environment. FIG. 2 illustrates a further prior art drain plug apparatus 5, wherein a resilient plug member 6 is positioned between a first and second compression plate 7 and 8 that may be secured together to compress the central plug 6 by a medially directed threaded fastener 9.

Figure 4:
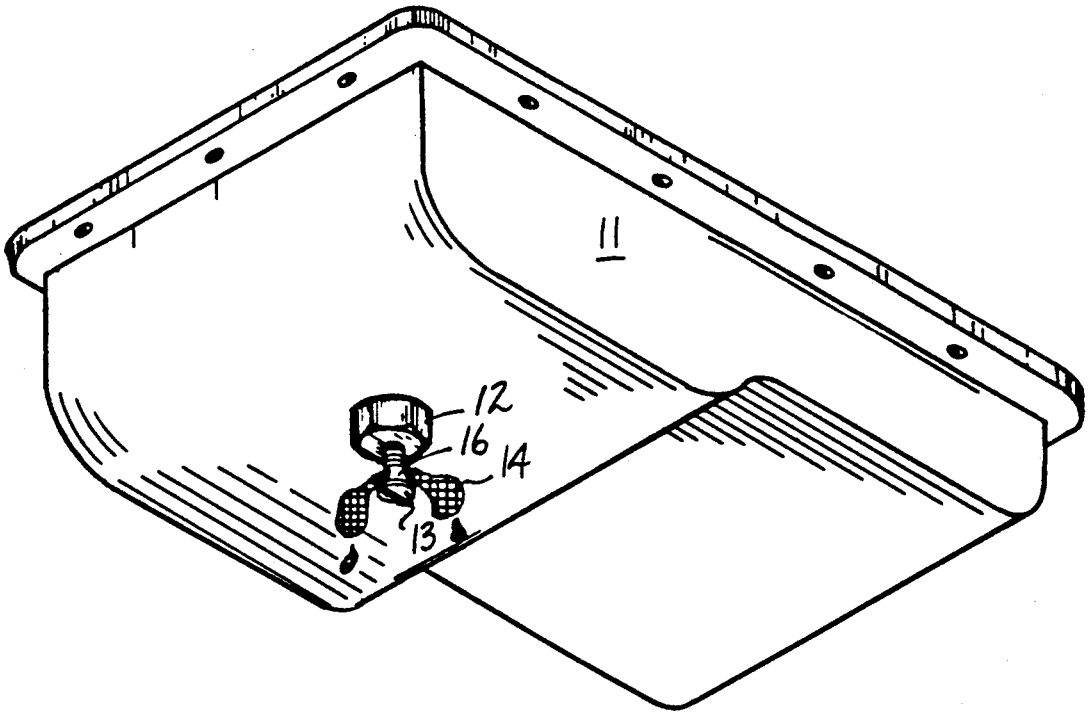
FIG. 4 is an isometric illustration of the instant invention in a discharge orientation relative to an associated reservoir.

More specifically, the drain plug apparatus 10 of the instant invention essentially comprises a fluid reservoir 11. Such fluid reservoir 11 is of universal application, and for example may be utilized in an internal combustion engine environment to accommodate a predetermined quantity of lubrication fluid. An internally threaded pressure nut 12 is fixedly mounted to a bottom surface of the fluid reservoir 11 in fluid communication with the reservoir. A discharge screw 13 is threadedly received within the pressure nut 12. FIG. 4 illustrates a directing of the discharge fluid 14 from within the fluid reservoir 11, wherein the discharge screw 13 is withdrawn from the pressure nut 12 by relatively rotating the discharge screw 13 to expose an associated conical head 16 of the discharge screw. The discharge screw 13 is illustrated in FIG. 9 and includes an elongate longitudinally aligned externally threaded screw shank 17, including a screw shank conduit 18 coaxially directed throughout the screw shank 17 and in fluid communication with a through-extending head conduit 19 orthogonally directed through the conical head 16. In this manner, fluid is directed from interiorly of the reservoir 11, then through the screw shank conduit 18 and discharged through the opposed openings formed in the conical head 16 by the through-extending head conduit 19. A slot 20 is formed on an exterior face of the conical head 16 for engagement by a bladed tool and the like, wherein understandably various mechanical configurations may be included to accommodate such tools as a hex head socket and the like.

Figure 5:
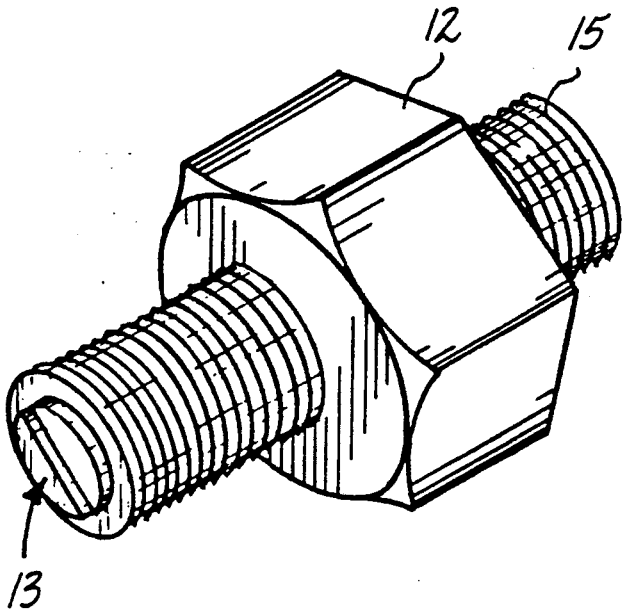
FIG. 5 is an isometric illustration of the instant invention utilizing an elongate boss receiving a discharge screw of the instant invention.
Figure 6:
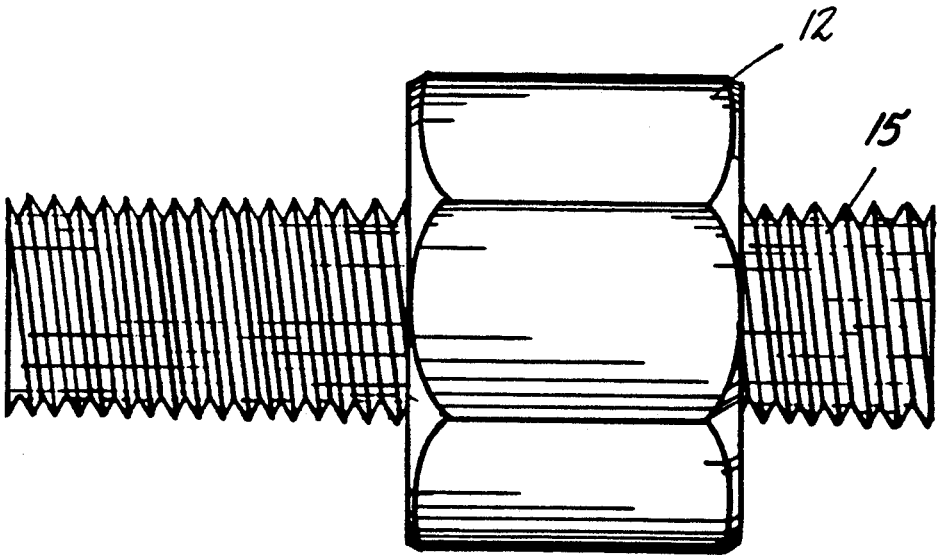
FIG. 6 is an orthographic side view of the instant invention as set forth in FIG. 5.
Figure 7:
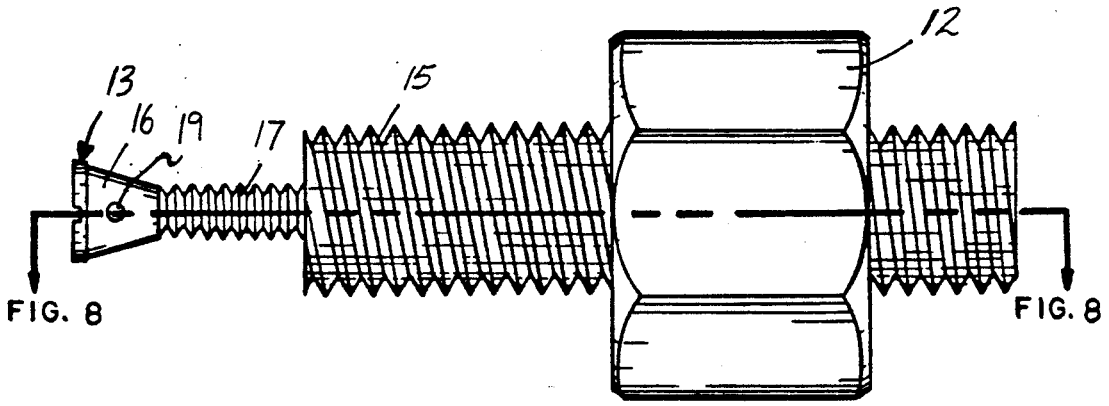
FIG. 7 is an orthographic side view, taken in elevation, of the instant invention as set forth in FIGS. 5 and 6.
Figure 8:
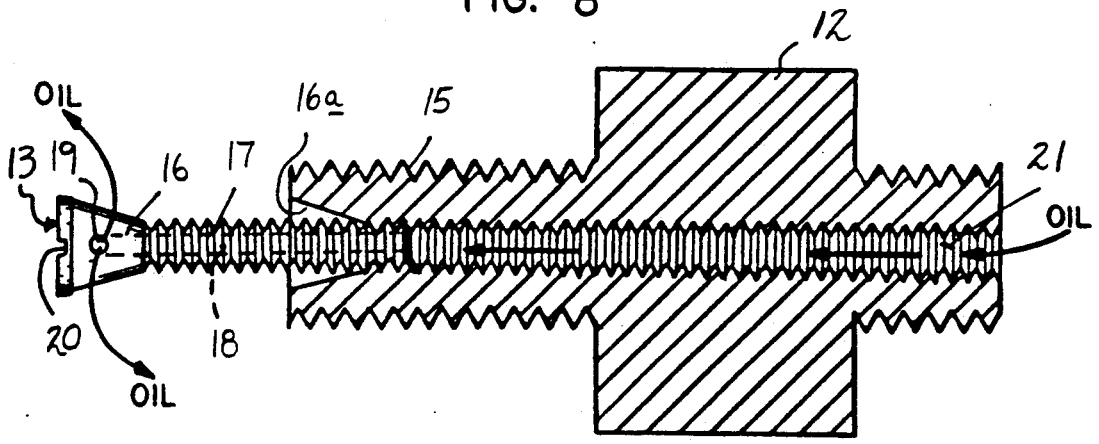
FIG. 8 is an orthographic cross-sectional view, taken along the lines 8—8 of FIG. 7, in the direction indicated by the arrows.

FIGS. 5 and 6 illustrate the use of the pressure nut 12 and an internally threaded hollow boss 15. Reference to FIGS. 7 and 8 illustrate the discharge screw 13 threadedly received within the internally threaded hollow boss 15 that is defined by a boss conduit 21. In this manner, retraction of the discharge screw 13 from the hollow boss 15 permits a discharge fluid such as oil and the like to be directed through the boss conduit 21 and through the discharge screw 13 in a manner as set forth above. The hollow boss 15 includes a conical cavity **16*a* coaxially aligned with the boss conduit 21 and is of a complementary configuration to that defined by the conical head 16 such that a seating of the conical head 16 within the cavity 16*a* effectively seals fluid contained within the reservoir 11 prior art a spacing of the conical head 16 relative to the hollow boss 15. The hollow boss 15 is defined by a boss diameter greater than that defined by the conical head 16 to accommodate a flexible tube 22 thereover to permit discharge of fluid through the discharge tube from the discharge screw 13 into an underlying container 23 relative to the reservoir 11**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A drain plug apparatus in combination with a fluid reservoir, the fluid reservoir including a bottom surface, and an internally threaded pressure nut fixedly mounted to the bottom surface, the internally threaded pressure nut defined by a coaxially aligned internally threaded conduit, and an externally threaded discharge screw threadedly received within the conduit, and the discharge screw including an elongate longitudinally aligned shank, the shank including a shank conduit coextensive with and directed through the shank, and the discharge screw further including a conical member, the head member including a head conduit through-extending the head in fluid communication with the shank conduit, and wherein the shank conduit is orthogonally oriented relative to the head conduit, and wherein the pressure nut includes a boss member extending beyond the pressure nut and integrally formed thereto, the boss member coaxially aligned with the pressure nut and the conduit, and wherein the boss member includes a conical recess coaxially aligned with the conduit formed within a forward end of the boss member of a complementary configuration defined by that of the conical head of the discharge screw, and wherein the head conduit is seated within the conical cavity in a first position and spaced from the conical cavity in a second position to expose the head conduit, and wherein the conical head of the discharge screw includes a diametrically aligned slot oriented to receive a blade member for removal of the discharge screw from the pressure nut.

2. An apparatus as set forth in claim 1 wherein the boss member is defined by a boss member diameter, and the conical head is defined by a conical head diameter, wherein the boss member diameter is greater than that defined by the conical head diameter.

3. An apparatus as set forth in claim 2 further including a flexible tube securable about the boss member to direct fluid from the fluid reservoir through the discharge screw and through the flexible tube to permit selective directing of the tube to an associated receiving container.

* * * * *